US006060833A

United States Patent [19]

Velazco

[11] Patent Number: 6,060,833

[45] Date of Patent: May 9, 2000

[54] CONTINUOUS ROTATING-WAVE ELECTRON BEAM ACCELERATOR

[76] Inventor: Jose E. Velazco, 10941 Keys Ct., Fairfax, Va. 22032

[21] Appl. No.: 08/953,722

[22] Filed: Oct. 17, 1997

Related U.S. Application Data

[60] Provisional application No. 60/028,784, Oct. 18, 1996.

[51] Int. Cl.[7] ..... H05H 15/00

[52] U.S. Cl. ..... 315/5.41; 315/500; 315/505

[58] Field of Search ..... 315/5.41, 5.42, 315/5.29, 500, 505

[56] References Cited

U.S. PATENT DOCUMENTS

| | | | |
|---|---|---|---|
| 3,398,376 | 8/1968 | Hirshfield | 330/4 |
| 3,450,931 | 6/1969 | Fienstein et al. | 315/5.41 X |
| 3,463,959 | 8/1969 | Jory et al. | 315/5 |
| 3,916,239 | 10/1975 | Friedlander | 313/460 |
| 3,965,434 | 6/1976 | Helgesson | 315/5.41 X |
| 4,143,299 | 3/1979 | Sprangle et al. | 315/5.41 |
| 4,253,068 | 2/1981 | Barnett | 330/4 |
| 4,422,045 | 12/1983 | Barnett | 330/4 |
| 4,641,103 | 2/1987 | Madey et al. | 315/5.29 X |
| 4,642,591 | 2/1987 | Kobayashi | 333/227 |
| 4,835,446 | 5/1989 | Nation et al. | 315/5.13 |
| 5,073,913 | 12/1991 | Martin | 378/34 |
| 5,280,252 | 1/1994 | Inoue et al. | 315/5.41 X |
| 5,361,274 | 11/1994 | Simpson et al. | 372/72 |
| 5,363,054 | 11/1994 | Bekefi | 330/4 |
| 5,523,659 | 6/1996 | Swenson | 315/506 |

*Primary Examiner*—Benny T. Lee
*Attorney, Agent, or Firm*—Nixon & Vanderhye P.C.

[57] ABSTRACT

An electron beam accelerator utilizes a single microwave resonator holding a transverse-magnetic circularly polarized electromagnetic mode and a charged-particle beam immersed in an axial focusing magnetic field. The combined effect of the transverse-magnetic microwave fields and the axial magnetic field provide the electron beam with a helical shape and a rotational motion which allows the entire beam to be continually accelerated to high energies in a dc-like fashion. The use of the transverse-magnetic circularly polarized electromagnetic mode allows the resonant frequency to be independent of resonator length—allowing the resonator length to be selected to achieve desired particle acceleration. Using a transverse-magnetic rotating wave mode, $TM_{110}$, allows the cavity frequency to be independent of cavity length and eliminates the need for bunched beams and short cavities while allowing the use of a spiraling moving beam. The rotating wave electron beam has a number of applications including, for example, a compact, pulsed high energy electron beam generator within tool casing.

39 Claims, 6 Drawing Sheets

FIG. 4
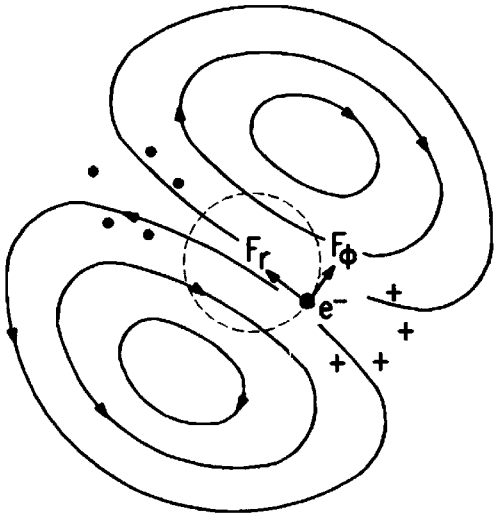
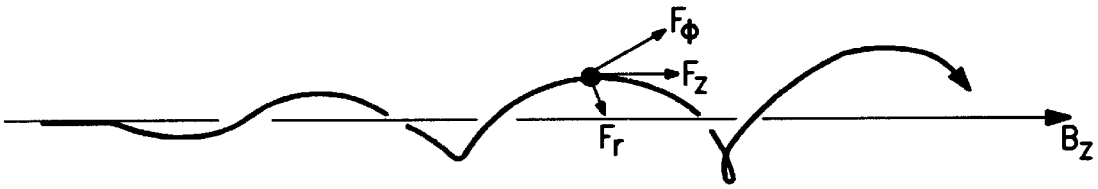
FIG. 5
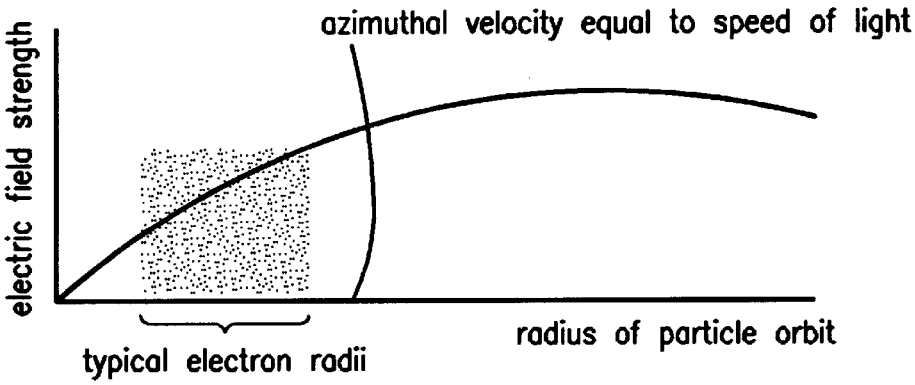
FIG. 6

CONTINUOUS ROTATING-WAVE ELECTRON BEAM ACCELERATOR

CROSS-REFERENCES TO RELATED APPLICATIONS

This application claims the benefit of Provisional Patent application No. 60/028,784, filed Oct. 18, 1996.

FIELD OF INVENTION

This invention relates in general to the field of high energy charged particle beam-wave accelerators which operate at relativistic energies, e.g., 100 keV to 100 MeV, and more particularly, to improvements in linear and cyclotron high energy charged particle beam-wave accelerators.

BACKGROUND OF THE INVENTION

Microwave linear accelerators which use oscillating electric fields to accelerate charged particles (such as electrons) have been used for years as a way to overcome the maximum voltage limitations of static accelerator fields. In a microwave linear accelerator, a stream of electrons is typically passed through a set of microwave cavities containing oscillating electric fields. These oscillating electric fields accelerate the electron stream. Because the accelerating electric fields in these cavities are oscillating periodically, they are only in the correct direction for half the microwave period. To ensure that the fields accelerate rather than decelerate the electron stream, the cavities containing these fields are made short enough so that an electron can completely traverse the length of the cavity before the cavity field reverses to the unwanted direction.

Such known microwave linear accelerators have certain problems. One significant problem is that the short microwave cavity length limits the acceleration force that can be applied to the electrons. This problem has been dealt with in the past by providing additional cavities phased such that the accelerated electrons will find the electric field in the correct direction during the electrons' transit through each successive cavity. This solution increases the amount of acceleration force, but also increases the size and complexity of the linear accelerator.

Another problem with such known microwave linear accelerators relates to their efficiency. In a short linear accelerator, the electron source (e.g., an electron gun) typically produces a continuous stream of electrons. However, only a fraction of these electrons that happen to be properly timed will be successfully accelerated by the linear accelerator. Electrons not properly timed will not be correctly accelerated, and will eventually hit the cavity walls. Thus, discrete bunches and/or batches of successfully accelerated particles will emerge from the linear accelerator at every microwave cycle as opposed to a continuous stream of accelerated electrons. This effect translates into lower accelerated beam power.

Another type of accelerator is known as a "cyclotron accelerator." When people hear the term "cyclotron" they often think of huge systems spanning several miles used to generate extremely high energy particles for "smashing atoms." However, not all cyclotron accelerators are huge. Generally, a "cyclotron" is a circular particle accelerator in which charged subatomic particles generated at a central source are accelerated spirally outward in a plane perpendicular to a fixed magnetic field by an alternating electric field.

Some past known cyclotron accelerators utilize transverse-electric (TE) electromagnetic modes to produce acceleration of an electron beam immersed in an axial focusing magnetic field. Such cyclotron wave accelerators accelerate a charged particle in the direction of power flow of the electromagnetic wave energy in a manner such that the frequency of the wave as seen by the particle is Doppler shifted to a lower value. The decrease in frequency as seen by the particle is exactly the amount necessary to compensate for the lower cyclotron frequency that results from the relativistic increase in particle mass. To operate efficiently, such past cyclotron accelerators require that the following condition is met, $$\Omega_c<\omega \tag{1}$$

where $\Omega_c$ is the relativistic cyclotron frequency and $\omega$ is the angular frequency of the wave.

A traveling wave cyclotron accelerator may, for example, use a cylindrical waveguide containing a circularly polarized transverse-electric traveling mode microwave wave as the means to produce beam acceleration. One limitation that such traveling wave cyclotron accelerators present is that, for a reasonable amount of input microwave power, the microwave electric field inside the waveguide is relatively weak. These fields are not strong enough to produce rapid acceleration of the particles—and thus require a long interaction to produce substantial acceleration of the particle beam. For instance, one example cyclotron accelerator using a 70 cm-long waveguide operating in a $TE_{11}$ mode has been able to accelerate an electron beam up to 360 keV but requires 5 megawatts (that is 5 million watts) of microwave power. See Hirshfield, J. et al., Phys. Plasmas, 3, 1996, pp. 2163–2168. Although these devices can efficiently produce beam acceleration, they are typically large (at least in part because of the high microwave power required) and have only been able to produce low levels of energy gain. This is a big disadvantage for applications where compact and lightweight accelerating structures are required for the production of high-energy charged particles.

Cyclotron accelerators have been constructed using a microwave cavity employing a short cylindrical resonator holding a $TE_{111}$ circularly polarized mode for particle acceleration. These cavity accelerators are much more compact than their traveling wave counterparts. However, one drawback of these cavities is that their dimensions (cavity radius and length) are both frequency dependent. That is to say, at a given frequency of operation, the cavity length becomes rather short if a reasonable cavity cross-section (radius) is to be obtained. It becomes very difficult to construct suitable magnetic coils around the short cavity to provide the required non-uniform up-tapered axial magnetic field profile to maintain cyclotron resonance throughout the beam path. Consequently, cavity cyclotron accelerators are forced to use a constant magnetic field whose amplitude is selected to maximize beam acceleration. Because of these reasons, the condition given by Eq. 1 above cannot be satisfied throughout the beam path and only low energy gains can generally be achieved with this type of accelerators. For example, a cavity cyclotron accelerator experiment designed to operate at a frequency of 2.82 GHz, employing a cylindrical cavity with a radius and length of 3.8 cm and 9.3 cm, respectively, yielded electron beam acceleration up to 500 keV using a uniform magnetic field of 1.4 kG. See Mc Dermott, D. B., et al., J. Appl. Phys. 58, 1985, pp. 4501–4508.

SUMMARY OF THE INVENTION

The present invention solves the above-mentioned problems by providing more compact, efficient and improved high power charged particle beam accelerator apparatus and techniques.

Briefly, the present invention provides a technique for producing an accelerated charged particle beam that involves injecting charged particles into a resonant rotating microwave field exhibiting a transverse magnetic rotating wave mode having no axial periodicity; and using the rotating microwave field to both accelerate and spiral the particles to produce an accelerated beam.

In more detail, a rotating wave electron beam accelerator provided in accordance with the present invention includes a microwave resonator and a particle generator coupled to the resonator. The particle generator injects charged particles into the resonator. A radio frequency source coupled to the resonator induces, within the resonator, a resonant rotating microwave field exhibiting a transverse magnetic rotating wave mode having no axial periodicity.

The rotating microwave field has both magnetic and electric field components. The rotating microwave magnetic field component causes the particles to spiral along a helical path, and the microwave electric field component accelerates the particles.

In accordance with a further aspect provided by the present invention, the resonator has a length that is independent of the frequency of the resonant microwave field—and the resonator is radially dimensioned to determine the frequency of the resonant microwave field.

The resulting overall device can be very efficient and compact, and has numerous applications for example, as an electron source, and as an x-ray source in medicine, industry and defense.

Additional features and advantages provided by the present invention include:

- a rotating-wave accelerator that provides a continuous stream of monochromatic charged particles employing a relatively short (e.g., $TM_{110}$) rotating mode cavity with a suitably up-tapered axial focusing magnetic field.
- a rotating-wave accelerator using a transverse-magnetic rotating wave mode, $TM_{110}$, that allows the cavity frequency to be independent of cavity length.
- a rotating-wave accelerator using a relatively unknown rotating (or circularly polarized) type of microwave field which has constant, but rotating fields, to eliminate the need for bunched beams and short cavities while allowing the use of a spiraling moving beam.
- an improved system and method for accelerating charged particle beams using transverse-magnetic ($TM_{110}$) circularly polarized (rotating-wave) electromagnetic fields.
- an improved system and method for producing a continuous stream of monochromatic high-energy charged particles forming a helical beam having axial and rotational motion of a beam spot, such a spot rotating temporally about the device axis with a frequency equal to the radiation frequency $\omega$, with the individual electrons rotating at the cyclotron frequency $\Omega_c$.
- an improved system and method for providing acceleration of a charged particle beam employing a transverse-magnetic ($TM_{101}$) rotating-wave field with a relatively short microwave cavity whose length, being frequency independent, can be arbitrarily selected so as to maximize beam acceleration.
- an improved system and method for providing a transverse-magnetic ($TM_{110}$) rotating-wave cavity with a suitable length which allows the construction of a properly up-tapered non-uniform axial magnetic field around it that yields substantial beam acceleration.
- an improved system and method for providing for maximum acceleration of a charged particle beam, by setting the relativistic cyclotron frequency of the electrons throughout the beam path equal to the frequency of operation of the cavity, i.e., $\Omega_c=\omega$ (this condition can be called "gyroresonance").
- an improved system and method for providing a charged particle extractor means for converting a rotating and axially translating helix into a pure axially translating beam which can subsequently be directed towards a target by means such as magnetic mirroring techniques.
- an improved system and method for providing permanent magnet means to achieve the properly shaped magnetic field profile for beam acceleration and extraction.
- an improved system and method for providing a compact charged particle accelerator which can be used for a large number of industrial, medical and defense applications. These applications include but are not limited to x-ray machines for medical radiotherapy, explosive detection, oil logging, structural inspection of airplanes, bridges, and other structures, electron beam machines for ionizing radiotherapy, electron beam welding, material hardening, food processing, sterilization of disposable medical products, and other applications.

BRIEF DESCRIPTION OF THE DRAWINGS

These and other features and advantages provided in accordance with the present invention will be better and more completely understood by referring to the following detailed description of presently preferred example embodiments in conjunction with the drawings, of which:

FIG. 4 shows an exemplary electron orbit with respect to the fields of a $TM_{110}$ rotating mode under gyroresonance;

FIG. 5 shows an example electron orbit along the z axis under gyroresonance where one can note that the electron radial displacement gradually increases as it moves along the z axis;

FIG. 6 shows an example plot of the rf electric field that an electron "sees" as a function of radial displacement;

DETAILED DESCRIPTION OF PRESENTLY PREFERRED EXEMPLARY EMBODIMENTS

Figure 1:
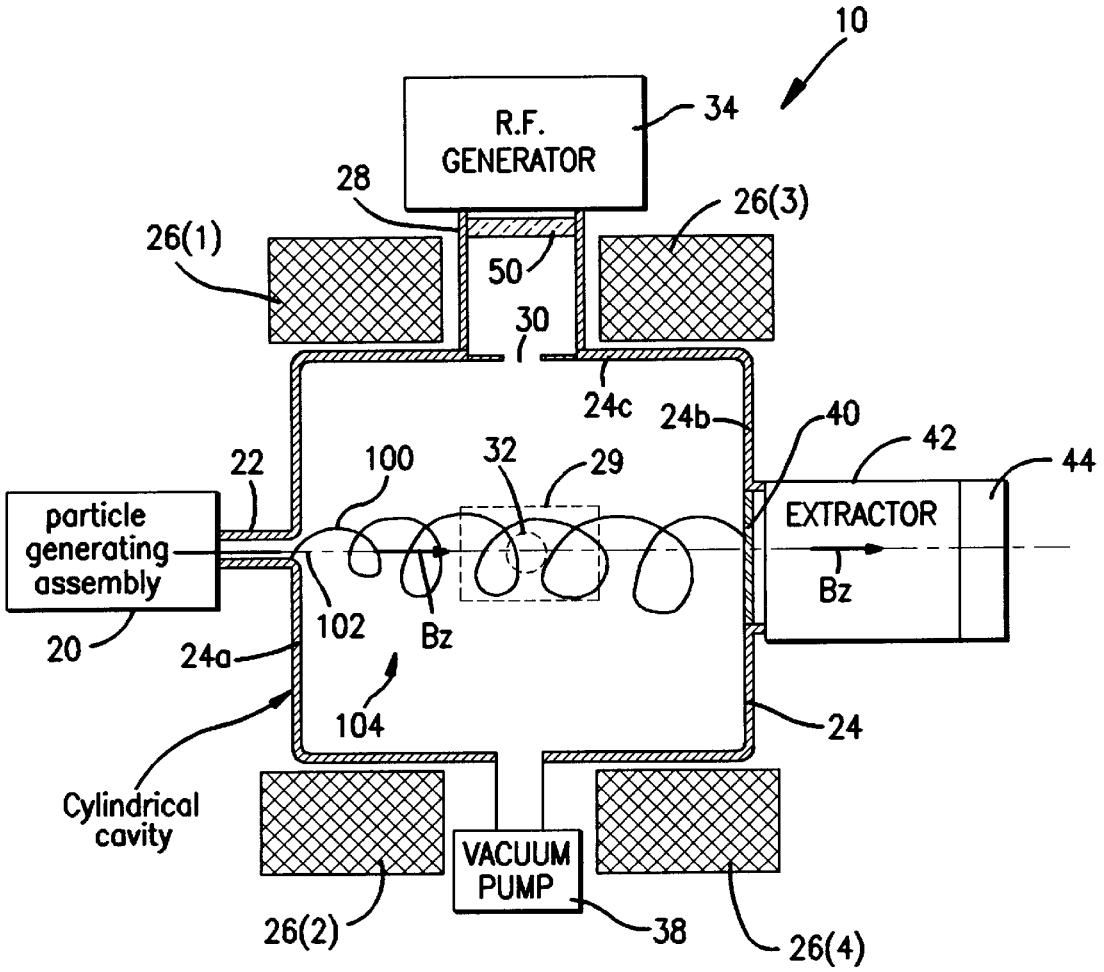
FIG. 1 is a schematic illustration of an example embodiment of a rotating-wave accelerator in accordance with the present invention.
Figure 1A:
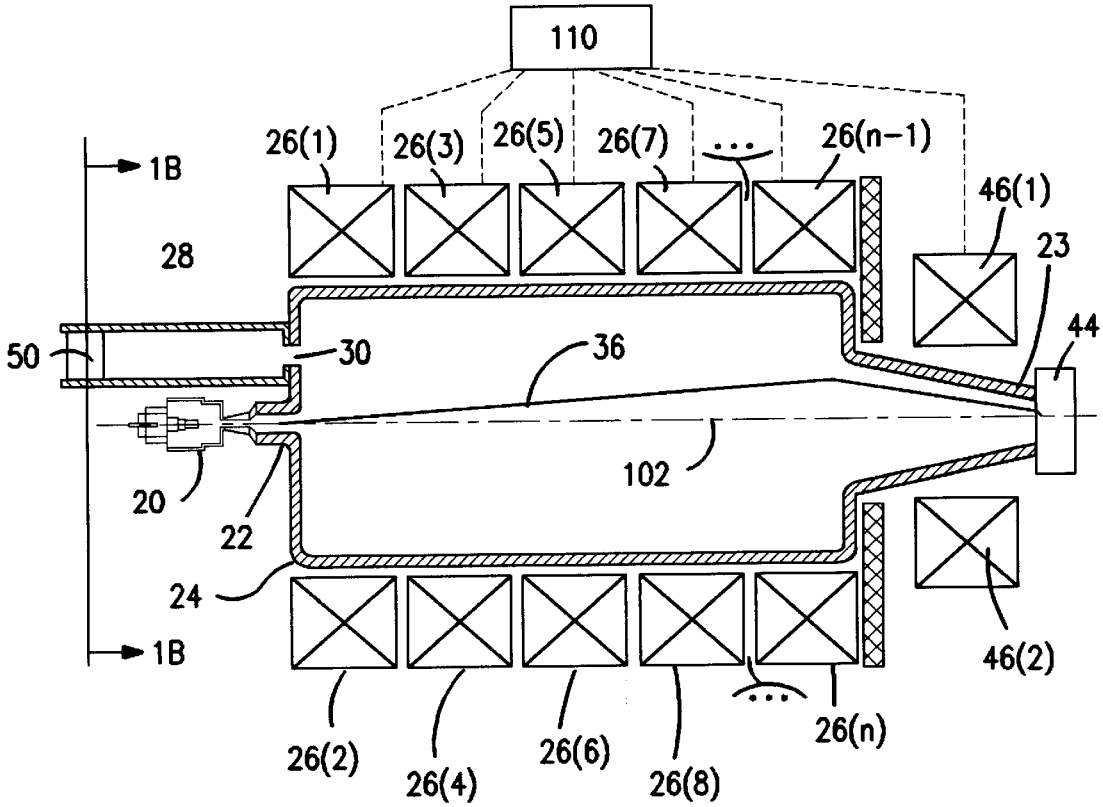
FIGS. 1*a* and 1*b* show front and side views respectively of an exemplary embodiment of a rotating-wave accelerator provided in accordance with the present invention.
Figure 1B:
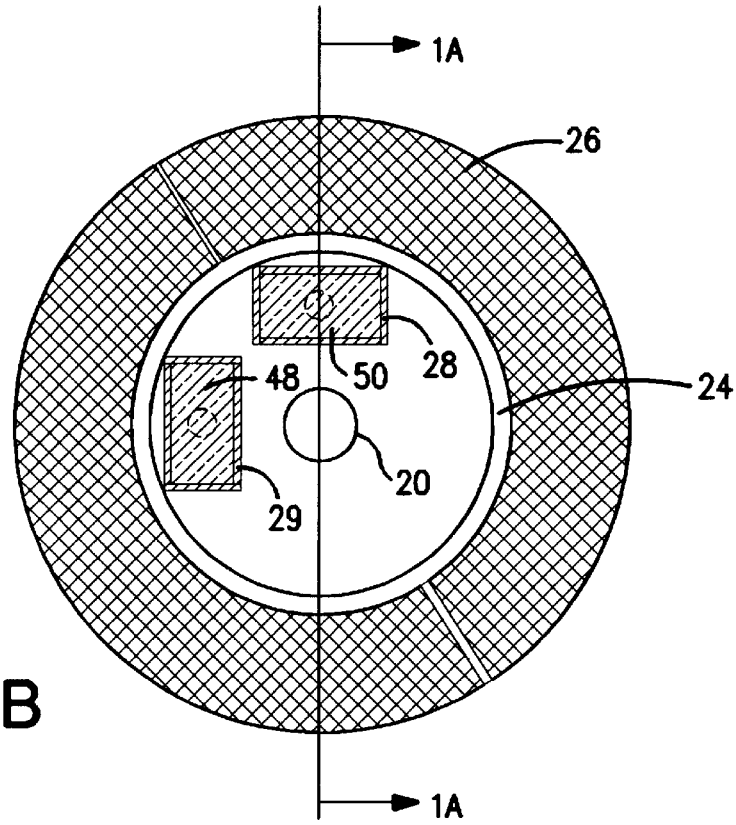

An exemplary embodiment of an accelerator 10 provided by the present invention is illustrated in FIGS. 1, 1A and 1B. The exemplary embodiment rotating wave accelerator 10 uses several strategies to cope with the alternating nature of microwave fields used in linear accelerators to achieve compactness and efficiency. In particular, it employs a relatively unknown rotating (or circularly polarized) type of microwave field transverse-magnetic rotating wave mode, $TM_{110}$ which has constant, but rotating fields. This mode allows the frecuency of cavity 24 to be independent of cavity length; and it eliminates the need for bunched beams and short cavities while allowing the use of a spiraling moving beam.

One interesting feature of the field combination is that it creates both the spiraling beam (see FIG. 1) and also goes on to accelerate it—whereas most other microwave accelerators require separate structures: one to prepare the beam (bunch it) and another one to accelerate it. In the present invention, the microwave magnetic fields produce the spiraling beam 100, and the microwave electric field accelerates it. Furthermore, the accelerating structure in a normal microwave accelerator is further composed of many short cavities because of the transit time condition. On the other hand, because the cavity 24 can be made to any length, the FIG. 1 example can use a single long cavity 24 to prepare and totally accelerate the beam to its final energy.

In more detail, the rotating-wave accelerator in FIGS. 1, 1A and 1B includes a particle generating assembly 20 (see FIG. 1); a cylindrical microwave resonator 24 (see FIG. 1); waveguides 28, 29 (see FIG. 1); a thin foil 40 (see FIG. 1); a target 44 (see FIG. 1); drift tubes 22, 23 (see FIG. 1); a focusing magnetic system 26 (see FIG. 1); coupling apertures 30, 32 (see FIG. 1); a radio-frequency (rf) generator 34 (see FIG. 1*a*); a vacuum pump 38 (see FIG. 1*b*); a beam extractor 42 (see FIG. 1); a compression coil 46 (see FIG. 1); vacuum windows 48 (see FIG. 1, 1*a*, 1*b*), 50 (see FIG. 1*b*). The cylindrical cavity 24 (see FIG. 1) is evacuated to a suitable low pressure, (e.g. $10^{-9}$ Torr) by means of a suitable vacuum pump means 38 (see FIG. 1).

As best seen in FIG. 1, the particle generating assembly 20 (which may be an electron gun) is disposed at the upstream end portion of 24*a* of cavity 24. Particle generating assembly 20 produces and directs an electron beam 100 into cavity 24 along central beam axis 102 of accelerator 10. A cut-off tubing section 22 prevents microwave energy within cavity 24 from flowing into the region of particle generating assembly 20 while permitting the electron beam 100 produced by the particle generating assembly to enter the rotating-wave accelerator region 104 within cavity 24 (see FIG. 1). The rotating-wave accelerating region 104 is defined within a circular cylindrical cavity 24 coaxially disposed about the central axis 102 and terminating at a downstream end portion 24*b* thereof by any suitable load means such as a thin aluminum foil 40 which will maintain vacuum integrity while permitting the accelerated electrons to pass therethrough.

Cavity 24 can be excited with circularly polarized $TM_{110}$ rotating waves by providing a pair of 90° azimuthal space rotating coupling apertures 30, 32 in the front wall 24*c* of the cylindrical cavity 24. The coupling apertures 30, 32 are fed via waveguides 28, 29 (see FIG. 1B) by a suitable rf drive system that includes an rf generator 34. Power from the rf generator 34 can be fed into the input waveguide ports 28, 29 via conventional vacuum window flange assemblies 48, 50 (see FIG. 1B) to excite a circularly polarized $TM_{110}$ rotating wave inside accelerator cavity 24. For example, an rf signal generator such as a klystron or magnetron can feed a 3 dB hybrid coupler with one port terminated in a matched load. The coupler splits the input energy from the generator into two 90° time phased equal amplitude waves which are coupled via any conventional coupling means, e.g., waveguide into the waveguides 28, 29 via conventional vacuum window flange assemblies 48, 49 to generate a $TM_{110}$ rotating wave inside resonator 24.

The electron beam emanating from particle generating assembly 20 will assume a helical trajectory of expanding radius 36 (see FIG. 7) which is a general representation of the motion. A suitable magnetic field generator 26 (such as, e.g., solenoid windings and associated magnetic field adjuster 110 produces an appropriate axial magnetic field profile 52 (see FIG. 2). The magnetic field produced by magnetic field generator 26 is adjusted to achieve "gyroresonance" (as discussed below). The rapid (i.e., sudden) variation of the axial magnetic field profile at the end of the cavity from Bzm to 0, sometimes denoted as "magnetic-cusp," can be obtained by means of extractor 42, such as, for example, a disk made out of magnetic material such as, e.g. soft iron. Focusing of the particle beam 36 along cut-off drift tube 23 (see FIG. 1*a*) towards an on-axis target 44 can be achieved by means of a compression coil 46 (see FIG. 1, 1A). Drift tube 23 is properly shaped so as to prevent flow of microwave energy therethrough. Examples of magnetic field generator 26 include but are not limited to, solenoids, electromagnets, super-conducting magnets and permanent magnets.

Figure 3:
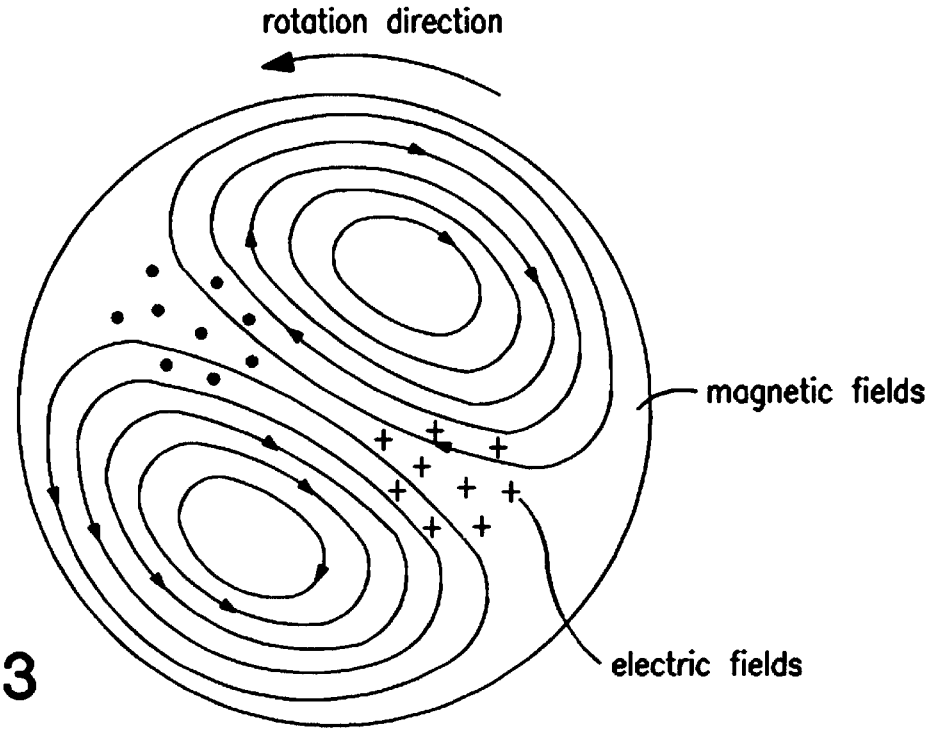
FIG. 3 shows an example of the electric and magnetic field lines of the rotating $TM_{110}$ mode.

Accelerator cavity 24 in this example is cylindrical in geometry and operates in a transverse-magnetic rotating wave mode, $TM_{110}$. FIG. 3 shows an exemplary cross-section of cavity 24 including electric and magnetic field lines of the $TM_{110}$ rotating mode. The three mode indices: 1, 1, 0, indicate the fields dependence on the azimuthal, radial and axial coordinates of the cavity 24, respectively. The first index (1) indicates the azimuthal periodicity of the mode, the second index (1) denotes the radial periodicity of the mode whereas the third index (0) indicates the axial periodicity of the mode. Consequently, in this mode the fields do not have axial periodicity, unlike $TE_{111}$ modes, and thus are independent of the length of cavity 24. In consequence, the radius of cavity 24 is the only dimension that dictates the frequency of operation of the cavity. The length of cavity 24 (axial dimension), is totally frequency independent and thus can be freely adjusted.

Figure 2:
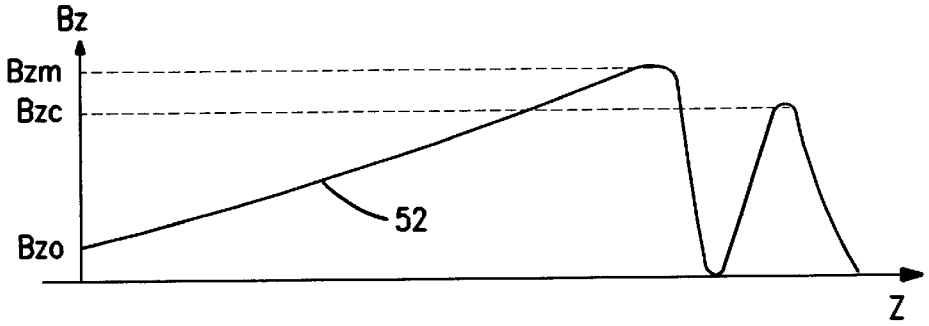
FIG. 2 shows an example profile of the axial magnetic field along the beam path to provide gyroresonance for substantial beam acceleration and for beam extraction.
Figure 9:
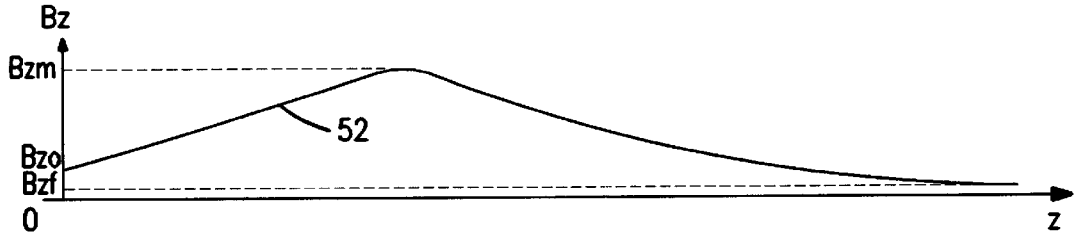
FIG. 9 shows an exemplary profile for the magnetic field along the beam extractor region that provides gradual (adiabatic) magnetic decompression of the charged particle beam produced by the accelerator.

In FIG. 9 a modification of the extractor field shown in FIG. 2 is depicted as magnetic Field profile 52 which involves the gradual (adiabatic) decrease of the axial magnetic field from Bzm to Bzf. This gradual reduction of the magnetic field will convert the rotating axially translating helical beam into an expanding helix which describes a conical surface. By decreasing the magnetic field adiabatically, the transverse velocity of the rotating beam is gradually converted into axial velocity as the radial position of the beam is also gradually enlarged from its initial value at the exit of the accelerator cavity 24. The change in transverse velocity is equal to the square root of Bzf/Bzm whereas the change in radial position is proportional to the square root of Bzm/Bzf. In this case the drift tube 23 should be properly shaped to fit the conical particle beam.

The profiles of the axial magnetic field illustrated in FIGS. 2 and 9 can be implemented by any well known manner such as varying the number of turns of solenoid 26 or by independently powering a set of discrete electromagnet coils 26 by means of a magnetic field adjuster 110. An example of the magnetic field adjuster could be a set of power supplies or pulsers each designed to deliver a proper amount of current to each coil 26. If a single solenoid 26 with an axially-varying number of turns is employed, a single power supply could be used to provide the necessary current to the solenoid.

To produce the extractor field profile shown in FIG. 9 (from Bzm to Bzf), conventional means can be utilized such as a properly wound solenoid or discrete electromagnet coils. If a set of coils of roughly the same dimensions is employed, each coil could be driven with a different current by magnetic field adjuster 10 or the coils can be electrically connected in series and field adjusted 110 can provide a single amount of current. In the latter case, the axial distance between consecutive coils should be gradually increased so as to produce the desired (down-tapered) field profile.

For applications of the rotating wave accelerator where compactness and electrical efficiency are prime, a compact permanent magnet can be utilized to provide the field profiles shown in FIGS. 2 and 9. Permanent magnets are typically designed with ferromagnetic materials such as Alnico or rare earth materials such as Samarium Cobalt that can be magnetized to provide complicated magnetic field profiles. See Clark J and Leupold, H., IEEE Trans. Magn. MAG-22, 1986, pp. 1063–1065. In addition to its compactness, a permanent coil eliminates the need of field adjuster 110 providing an efficient and lightweight focusing system.

PRINCIPLES OF OPERATION

A free electron moving under the presence of a static magnetic field Bz with a velocity perpendicular to the field will travel in a circle with an orbiting frequency (called the cyclotron frequency) given by $$\Omega_c = \frac{eB_z}{m}\sqrt{1-\left(\frac{v}{c}\right)^2} \tag{2}$$

where v is the particle velocity, c is the speed of light and e and m are, respectively, the electron's charge and mass. We define the z direction as being the direction of the static magnetic field. In the case of the rotating wave accelerator, the electrons in the electron beam are injected into the accelerator 10 with an initial velocity $v_z$ in the z direction along the direction of the static magnetic field and will travel along a straight axis 102 unless they are given some velocity component perpendicular to the magnetic field. However, if they are given some perpendicular velocity, then they will orbit (or precess) around the magnetic field direction (as discussed above) in addition to the z directed motion. In this latter case, both these motions together will cause the electrons to travel along a helical path with the frequency of the orbiting still given by Eq. 2

In the rotating wave accelerator, we also provide a $TM_{110}$ rotating (or circularly polarized) microwave field as shown in FIG. 3. The fields in this mode oscillate and rotate about the cavity axis at the frequency ω. See J. Velazco and P. Ceperley, IEEE Trans. Microwave Theory Tech. MTT-41 (1993), pp. 330–335. The $TM_{110}$ mode is a cutoff mode having a z directed electric field Ez which is independent of z. In this orientation, the microwave magnetic field B interacts with the z directed velocity component of the electrons to create a perpendicular force on the electrons given by:

$$F_\perp = ev_z \times B \tag{3}$$

which will tend to give the electrons a perpendicular velocity component and thus cause them to have helical trajectories as discussed above.

In a rotating wave accelerator, the static axial magnetic field is adjusted so that the cyclotron frequency in Eq. 2 equals the frequency ω of the rotating microwave field, i.e., $\Omega_c=\omega$. Thus, $$B_z = \frac{mw}{\sqrt[e]{1-(v/c)^2}} \tag{4}$$

This condition is called gyroresonance. Under this condition, once the microwave magnetic field has started adding perpendicular velocity to the electrons and thus started the orbital motion, it will precess at the exactly same rate as the orbital motion, moving right around with the electrons as shown in FIG. 4 (where $F_\perp=F_\phi+F_r$). This rf magnetic field will continuously increase the perpendicular velocity of the electrons, further increasing the radius of their orbits and the diameter of the helical paths. The increasingly wide helical trajectory of a single electron is shown in FIG. 5. The radius of the orbital path is graphed in FIG. 6 versus distance for reasonable fields. Note that because of relativistic reasons, the helical path radius approaches a maximum limit (since the electrons radial velocity cannot exceed the speed of light).

The purpose of the above process is to set-up the electrons' trajectory and orbital frequency so as to allow the last set of fields to efficiently accelerate the electrons. These last fields are the rotating microwave electric fields Ez, shown in FIG. 3, which are in the z direction and rotate along with the microwave magnetic fields—and because of gyroresonance they also rotate along with the particles on their orbits. They exert a force $$F_z = eE_z, \tag{5}$$

in the z direction. Being synchronized with the particles, they continually push on the particles, in the z direction, continually adding to their energy and accomplishing the desired acceleration. All the forces are summarized in FIG. 5.

Figure 7:
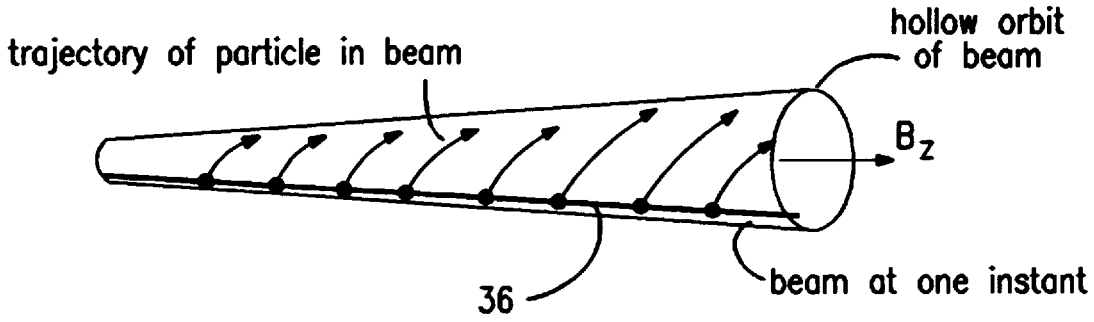
FIG. 7 shows an example snapshot of an electron beam moving under the influence of an axial magnetic field Bz as it is accelerated by the fields of a $TM_{110}$ rotating mode.

The trajectory of FIG. 5 is the path that a single electron in the beam moves along. However a snap shot of the beam at one instant in time would show the beam to appear as a slightly bent straight line, as shown in FIG. 7. This whole beam is at the azimuthal angle of the maximum positive microwave electric field and rotates as a whole around the axis as indicated in the drawing. Under these conditions, all the electrons forming the beam undergo equal acceleration inside cavity 24 in a dc-like fashion. Thus, at the end of cavity 24, a monochromatic helical rotating beam is obtained.

As shown in FIG. 5, the most effective acceleration occurs after the helical path has broadened sufficiently to place the electrons in a reasonably strong electric field region. Note also that the static, axial magnetic field needs to increase with z along the z axis to maintain gyroresonance over the entire path as shown in FIG. 2.

FIG. 2 shows the profile of the axial magnetic field along the beam path necessary to provide gyroresonance for substantial beam acceleration and for beam extraction. Along the cavity, the field is carefully up-tapered from its initial value Bzo to its maximum value Bzm. The degree of taper should be gradual so as to prevent the particles' axial velocity to become negative in which case beam reflection towards the particle generating assembly 20 can occur. (Alternately, one could allow the magnetic field to be constant and achieve approximate or average gyroresonance. Computer simulations have verified this to be an effective alternative for relatively short accelerators.) The values of Bzo and Bzm can be found from Eq. 4 where the corresponding values of v should be replaced. (The electric field (rf voltage) inside cavity 24 should be properly adjusted to provide the desired beam acceleration.) In FIG. 2 the sudden field decrease from Bzm to 0 is achieved by inserting a disk extractor 42 made out of magnetic material such as soft iron. This pole disk 42 should be made thick enough to prevent saturation of the iron and with an inner diameter large enough to allow the free passage of the particle beam. As particles traverse this sudden field change, their transverse velocity is instantaneously converted into axial velocity while their radial position remains unaltered. The helical beam is thus changed from a helical beam carrying transverse and axial velocity components to a helical beam streaming with a velocity that is purely axial.

For magnetic compression of the beam towards the target, a compression field can be employed. The compression field is provided by compression coil 46 which is typically constructed with a short axial length and small radius. It provides a localized magnetic field with a maximum intensity Bzc and shape as show in FIG. 2 for compression of the particle beam towards the target. For example, in a typical compression coil, the coil radius and field intensity Bzc determine the focal length of the beam. The focal length is defined as the axial distance from the center of compression coil 46 to the point along the axis in which the particle beam crosses the axis. Once coil 46 is constructed (coil radius fixed), the focal length can be varied by adjusting the value of Bzc. This can be accomplished by varying the current provided by magnetic field adjuster 110 to compression coil 46. Increasing Bzc will decrease the focal length; conversely the focal length is increased by decreasing Bzc.

The focusing field profile shown in FIG. 9 can be used in some applications of the rotating wave accelerator. In this case the extractor field is gradually decreased (down-tapered) to allow gradual beam decompression wherein the particle beam's transverse velocity is converted into axial velocity. Beam decompressions is accompanied by an increase in the beam's radial distance from axis 102 (see FIGS. 1, 1A). At the end of the extraction field region, the particles motion is mostly axial with the beam spot rotating about the main axis 102 with a frequency equal to the radiation frequency ω. This kind of particle beam could be used for sterilization applications where goods such as food or medical supplies need to be radiated (scanned) over a wide area with an electron beam or x-rays.

Finally, the static axial magnetic field also serves a very important secondary function of focusing the electron beam, keeping it from spreading out due to the repulsive forces between the electrons. Many accelerators have such a field for this purpose alone.

Magnetic field generator 26 can be implemented by conventional means such as solenoids, electromagnets, super-conducting magnets and permanent magnets. For example, for the embodiment shown in FIG. 1A, magnetic field generator 26 could be implemented by using a set of electromagnet coils 26(1), 26(2), 26(3), 26(4), 26(5), 26(6), 26(7), 26(8), . . . 26(n−1), 26(n) and compression coil 46. These coils can be equally dimensioned except compression coil 46 which can be made smaller. In this example, magnetic field adjuster 110 can be comprised of a set of power supplies, each capable of providing a suitable amount of electrical current to each coil. (Each coil is powered by its own supply). If a large amount of current needs to be delivered to the coils, the supplies can be designed to deliver pulses of electrical current to minimize excessive cost of supplies and heating problems with the coils. For applications in which Bzm is large (>1.5 Tesla), magnetic field generator could be implemented by means of super-conducting techniques.

Figure 8:
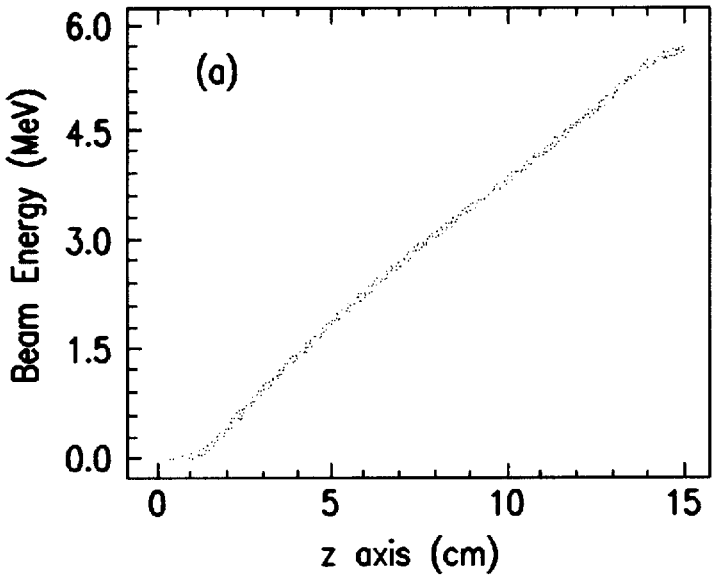
FIG. 8 shows the dynamics of an electron beam along the accelerating cavity of an example rotating-wave accelerator calculated on a commercial three-dimensional particle-in-cell electromagnetic code.

To illustrate the current embodiment of the present invention, we have performed computer simulations in a commercial three-dimensional particle-in-cell electromagnetic code. FIG. 8 shows the dynamics of an electron beam along the accelerating cavity of an example rotating-wave accelerator calculated on a commercial three-dimensional particle-in-cell electromagnetic code. FIG. 8 illustrates a typical result of beam acceleration simulations where the dynamics of an electron beam along the accelerating cavity 24 is shown. The beam energy (plotted on the vertical axis ranging from 0.0 to 6.0 Mega-electron-volts (MeV) in this example), shown as a function of interaction length, is seen to gradually increase as the beam traverses accelerator cavity 24 (shown on the horizontal axis as ranging from 0 to 15 centimeters (cm) along the z axis) achieving a final energy of 6 MeV. In the code, an electron beam with an initial energy of 5 keV and 100 mA current is injected into cylindrical cavity 24 holding a $TM_{110}$ rotating mode. The cavity frequency is 2.85 GHz, the peak rf voltage inside cavity 24 is set to 7.5 MV, the cavity length is 15 cm and the cavity radius is 6.4 cm. The axial magnetic field profile is linearly tapered from Bzo=1 kG to Bzm=8.5 kG to maintain gyroresonance.

EXEMPLARY APPLICATION OF THE INVENTION

The present invention has a wide range of different applications. For example, the rotating-wave accelerator 10 due to its compactness and relatively light weight should be suitable for medical and industrial applications. The kind of beam produced by the rotating-wave accelerator 10 (as shown in FIG. 7) should be also useful for microwave applications where 200–500 keV electron beams are required. In medical applications, the accelerator 10 should be able to provide 2–6 MeV electrons for radiotherapy machines. When compared with conventional medical accelerators, the rotating-wave accelerator 10 should require less drive rf power, should be smaller and more efficient, and will require a smaller electron gun.

Figure 10:
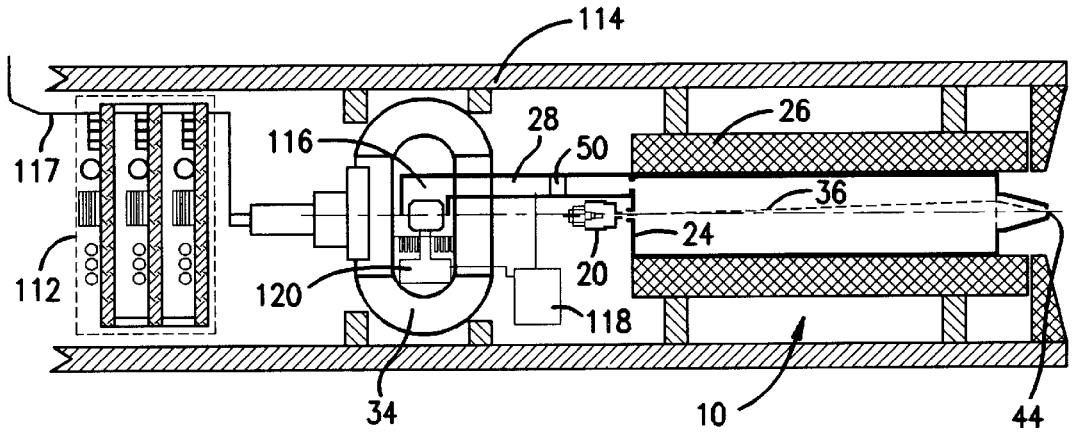
FIG. 10 shows a side view of a further exemplary rotating wave accelerator embodiment provided in accordance with the present invention.

FIG. 10 shows one example preferred embodiment in which the rotating wave accelerator 10 is provided within a tool casing 114. In this embodiment the entire accelerator system 10 including rf generator 34 and pulser circuit 112 is assembled inside a tool 114.

In more detail, rf generator 34, pulser circuit 112, and rotating wave accelerator 10 are all assembled inside tool casing 114. Rotating wave accelerator 10 is comprised of an electron gun 20, cylindrical resonator 24 holding a $TM_{110}$ rotating mode, driving waveguides 28, 29, coupling holes 30, 32, target 44 and permanent magnet field generator 26. Electron gun 20 is powered by pulser circuit 112 and produces a stream of low-energy electrons which are guided along the axis of cavity 24. Pulser circuit 112 provides electrical power for rf source 34 and particle generating assembly 20. Short electrical pulses, typically a few microseconds long, are produced by pulser circuit 112 to power magnetron rf source 34 and particle generating gun 20.

Pulser circuit 112 can be implemented by means of energy storage elements or pulse forming networks and can be switched by means of thyratrons or solid-state switches such as MOSFETs or IGBTs. Electrical power is fed through tool casing 114 to the pulser by electrical cable 117.

Rf generator 34 is a compact microwave source such as a coaxial magnetron and is powered by pulser circuit 112 which produces microsecond-long electrical pulses. Magnetron source 34 produces short microsecond bursts of microwave power at a frequency equal to the frequency of operation of cavity 24. Automatic frequency control system 118 keeps the frecuency of magnetron 34 equal to the operational frequency of resonator 24. Frequency adjustment of magnetron 34 is achieved by servo-driven tuner 120. A hybrid coupler 116 splits the microwave bursts coming from magnetron 34 into two equal-amplitude, 90°-phased signals which are subsequently sent to cavity 24 via waveguides 28, 29 through apertures 30, 32 to excite $TM_{110}$ rotating mode inside cavity 24.

Permanent magnet field generator 26 preferably provides a focusing magnetic field with a profile as shown in FIG. 2. Permanent magnet field generator 26 can be cylindrically shaped and made out of rare earth materials such as Samarium Cobalt to fit around cavity 24 and inside tool 114.

Cavity 24 is evacuated at low pressure ($10^{-9}$ Torr) and uses vacuum windows 48, 50 to preserve vacuum integrity. Electron source 20 produces a stream of electrons that are injected into cavity 24. Upon interacting with the fields of $TM_{110}$ rotating mode and axial focusing field, particle beam assumes broadening radial trajectory (see FIG. 7) as its is gradually accelerated to high energies. After acceleration, the particle beam is compressed towards target 44. Depending on the application, target 44 could be a thin foil or an X-ray target. If tool 114 is to be used, for example, as electron beam welder, target 44 could be a suitable thin aluminum foil that allows the passage of the beam for utilization of the charged particles. In applications where photon radiation is sought, target could be made out of tungsten for the generation of X-ray radiation.

As discussed above, tool 114 includes automatic frequency control 118 means for adjusting the frequency of magnetron rf source 34. Automatic frequency control senses the resonant frequency of accelerator cavity 24 and adjusts the frequency of magnetron rf source 34 via a servo-driven tuning plunger 120 in the magnetron 34.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims. Thus, although the description above contains many specifications, these should not be construed as limiting the scope of the invention but as merely providing illustrations of some of the presently preferred embodiments of this invention. The scope of the invention should be determined by the appended claims and their legal equivalents, rather than by the examples given.

What is claimed is:

1. A rotating wave electron beam accelerator including:

a microwave resonator;

a particle generator coupled to the resonator, the particle generator injecting charged particles into the resonator, said injected particles following a trajectory within said resonator;

a magnetic field generator coupled to the resonator, the magnetic field generator producing a magnetic field that is static in a direction axial to said particle trajectory; and a radio frequency source coupled to the resonator, the radio frequency source inducing within the resonator, a resonant circularly polarized microwave field exhibiting a transverse magnetic rotating wave mode having no axial periodicity, wherein the microwave and magnetic fields, acting together, accelerate and spiral the injected charged particles to produce a continuously rotating accelerated beam of charged particles.

2. A rotating wave electron beam accelerator as in claim 1 wherein said microwave field has both magnetic and electric field components, the microwave magnetic field component in conjunction with the static magnetic field cause the particles to spiral along a helical path, and the microwave electric field component accelerates the particles.

3. A rotating wave electron beam accelerator as in claim 1 wherein said transverse magnetic wave mode is described by the mode indices 1, 1, 0, indicating azimuthal, radial, and axial periodicity of the mode, respectively.

4. A rotating wave electron beam accelerator as in claim 1 further including extractor means coupled to the resonator for converting said continuously rotating charged particle beam into a pure axially translating electron beam, and means for directing the pure axially translating beam toward a target.

5. A rotating wave electron beam accelerator as in claim 1 wherein the resonant microwave field has a frequency and the resonator has a dimension that determines the frequency of the resonant microwave field.

6. A rotating wave electron beam accelerator as in claim 1 wherein the resonator is cylindrical in geometry.

7. A rotating wave electron beam accelerator as in claim 1 wherein a free electron moving under the presence of said magnetic field with a velocity perpendicular to the magnetic field will travel in a circle with an orbiting relativistic cyclotron frequency, and further including means coupled to the resonator for setting the relativistic cyclotron frequency of the particles traveling on a path across the resonator to be equal to a resonant frequency of said resonator.

8. A rotating wave electron beam accelerator as in claim 1 wherein the magnetic field generator includes at least one solenoidal electromagnet.

9. A rotating wave electron beam accelerator as in claim 1 wherein the magnetic field generator comprises a permanent magnet that achieves a magnetic field profile for acceleration and extraction of a beam comprising said particles.

10. A rotating wave electron beam accelerator as in claim 1 wherein the resonator has a length which allows generation of an up-tapered non-uniform axial magnetic field yielding substantial beam acceleration.

11. A rotating wave electron beam accelerator as in claim 1 wherein the particle generator comprises an electron gun that injects electrons into the resonator, said electron gun providing one of a continuous and a pulsed stream of charged particles.

12. A rotating wave electron beam accelerator as in claim 1 wherein the resonator is evacuated.

13. A rotating wave electron beam accelerator as in claim 1 wherein the resonator supports a circularly polarized $TM_{110}$ rotating wave as said rotating wave mode, the resonator has a wall including a pair of 90 degree azimuthal spaced coupling apertures, and the radio frequency generator is coupled to inject two 90 degree time-phased, equal amplitude microwave signals through the respective pair of apertures into the resonator, thereby exciting said circularly polarized $TM_{110}$ rotating wave within the resonator.

14. A rotating wave electron beam accelerator as in claim 1 wherein the resonator has an axial magnetic field profile and an output port including an extractor disk providing a sharp variation of the axial magnetic field profile of said resonator.

15. A rotating wave electron beam accelerator as in claim 1 wherein said resonant microwave field has a frequency and a free electron moving under the presence of said magnetic field with a velocity perpendicular to the microwave field will travel in a circle with an orbiting cyclotron frequency, and said resonator has an axis, and further including means for adjusting the microwave field and the magnetic field generator for the production of said accelerated beam of charged particles as a continuous stream of monochromatic high-energy charged particles in a helical beam having axial and rotational motion of a beam spot, the spot rotating temporally about the axis of said resonator with a frequency equal to the frequency of the resonant microwave field, with individual particles rotating at the cyclotron frequency.

16. A rotating wave electron beam accelerator as in claim 1 wherein the resonant microwave field has a frequency and the resonator has a length that is independent of the frequency of the resonant microwave field so as to achieve a desired acceleration of said particles.

17. A rotating wave electron beam accelerator including:

a microwave resonator;

a particle generator coupled to the resonator, the particle generator injecting charged particles into the resonator, said injected particles following a trajectory within said resonator;

a magnetic field generator coupled to the resonator, the magnetic field generator producing a magnetic field that is static in a direction axial to said particle trajectory; and a radio frequency source coupled to the resonator, the radio frequency source inducing within the resonator, a resonant circularly polarized microwave field exhibiting a transverse magnetic rotating wave mode having no axial periodicity, wherein the resonant microwave field has a frequency and the resonator has a length that is independent of the frequency of the resonant microwave field.

18. A rotating wave electron beam accelerator including:

a microwave resonator;

a particle generator coupled to the resonator, the particle generator injecting charged particles into the resonator said injected particles following a trajectory within said resonator;

a magnetic field generator coupled to the resonator, the magnetic field generator producing a magnetic field that is static in a direction axial to said particle trajectory; and a radio frequency source coupled to the resonator, the radio frequency source inducing within the resonator, a resonant circularly polarized microwave field exhibiting a transverse magnetic rotating wave mode having no axial periodicity, wherein the magnetic field generator comprises a permanent magnet that achieves a magnetic field profile for acceleration and extraction of a beam comprising said particles, and wherein the rotating microwave field has a frequency, a free electron moving under the presence of said magnetic field with a velocity perpendicular to the magnetic field will travel in a circle with an orbiting cyclotron frequency, and further including means coupled to the magnetic field generator for adjusting the magnetic field so that the cyclotron frequency equals the frequency of the rotating microwave field.

19. A method of producing an accelerated charged particle beam comprising:

(a) injecting charged particles into a field system comprised of an axial static magnetic field and a rotating microwave field exhibiting a transverse, circularly polarized mode having no axial periodicity; and (b) both accelerating and spiraling the particles with the rotating microwave field and the axial static field to produce an accelerated beam; and further including the step of providing an axial magnetic field profile exhibiting a sharp variation.

20. Apparatus for producing an accelerated charged particle beam comprising:

means for generating a resonant rotating microwave field exhibiting a transverse magnetic rotating wave mode having no axial periodicity;

means for generating an axial static magnetic field exhibiting a non-uniform profile; and means for injecting charged particles into said microwave and magnetic fields, wherein the microwave and magnetic fields, acting together, accelerate and spiral the injected particles to produce a continuously rotating accelerated beam of charged particles.

21. A method of producing an accelerated charged particle beam comprising:

(a) injecting charged particles into a field system comprised of an axial static magnetic field and a rotating microwave field exhibiting a transverse, circularly polarized mode having no axial periodicity; and (b) both accelerating and spiraling the particles with the rotating microwave field and the axial static field, acting together to produce a continuously rotating accelerated beam of charged particles.

22. A method as in claim 21 wherein said rotating microwave field has both magnetic and electric field components, and step (b) comprises using the rotating microwave magnetic field component in combination with the axial static magnetic field to cause the particles to spiral along a helical path, and using the microwave electric field component to accelerate the particles.

23. A method as in claim 21 wherein said step (a) comprises inducing, within an evacuated resonator as said transverse, circularly polarized mode, a transverse magnetic rotating wave mode described by the mode indices 1, 1, 0, indicating azimuthal, radial, and axial periodicity of the mode, respectively.

24. A method as in claim 23 wherein the rotating microwave field has a frequency, the resonator has a length, and further including the step of dimensioning the length of the resonator independently of the frequency of the rotating microwave field.

25. A method as in claim 23, the rotating microwave field has a frequency and said resonator has a radius, and further including dimensioning the radius of the resonator to determine the frequency of the rotating microwave field.

26. A method as in claim 23 wherein the rotating microwave field has a frequency, and a free electron moving under the presence of said magnetic field with a velocity perpendicular to the magnetic field will travel in a circle with an orbiting cyclotron frequency, said resonator has an axis, and step (b) includes producing said accelerated beam of charged particles as a continuous stream of monochromatic high-energy charged particles that form a helical beam having axial and rotational motion of a beam spot, the spot rotating temporally about the axis of said resonator with a frequency equal to the frequency of the rotating microwave field, with individual particles rotating at the cyclotron frequency.

27. A method as in claim 23 wherein the rotating microwave field has a frequency and the resonator has a length, and the method further includes selecting the length of the resonator independently of the frequency of the rotating microwave field so as to achieve a desired acceleration of said particles.

28. A method as in claim 23 wherein the resonator has a length, and the method further includes dimensioning the length of the resonator to allow generation of an up-tapered non-uniform axial magnetic field yielding substantial beam acceleration.

29. A method as in claim 21 wherein step (a) includes exciting a circularly polarized $TM_{110}$ rotating wave as said circularly polarized mode.

30. A method as in claim 21 wherein said injected particles follow a trajectory within said field system, and said step (a) includes the step of producing, as said axial static magnetic field, a magnetic field that is static in a direction axial to said particle trajectory.

31. A method as in claim 30 wherein the magnetic field producing step includes the step of achieving a permanent magnetic field profile for acceleration and extraction of a beam comprising said particles.

32. A method as in claim 31 wherein the rotating microwave field has a frequency, and wherein a free electron moving under the presence of said magnetic field with a velocity perpendicular to the magnetic field will travel in a circle with an orbiting cyclotron frequency, and further including the step of adjusting the static magnetic field so that the cyclotron frequency equals the frequency of the rotating microwave field.

33. A method as in claim 21 further including converting said continuously rotating charged particles into a pure axially translating beam of said particles, and directing the pure axially translating beam toward a target.

34. A method as in claim 21 wherein a free electron moving under the presence of said magnetic field with a velocity perpendicular to the magnetic field will travel in a circle with an orbiting relativistic cyclotron frequency, and further including the step of setting the relativistic cyclotron frequency of the particles to be equal to a resonant frequency of said rotating microwave field.

35. A tool providing a housing having the following combination of elements disposed at least in part therein:

a microwave resonator;

a pulsed particle generator coupled to the resonator, the particle generator injecting charged particles into the resonator;

a magnetic field generator coupled to the resonator, said magnetic field generator providing an axial static magnetic field;

a frequency controlled radio frequency source coupled to the resonator, the radio frequency source inducing within the resonator, a resonant circularly polarized microwave field exhibiting a transverse magnetic rotating wave mode having no axial periodicity, wherein the static magnetic field and the resonant circularly polarized microwave field, acting together, accelerate and spiral the injected charged particles to produce a continuously rotating accelerated beam of charged particles; and a pulser circuit coupled to the particle generator and to the radio frequency source, said pulser providing short electrical pulses to the particle generator and to the radio frequency source.

36. A tool as in claim 35 wherein the resonant microwave field has a frequency, the resonator has a resonant frequency, and:

the radio frequency source includes an automatic frequency control circuit that adjusts the frequency of the microwave field produced by the source to resonantly correspond to the resonant frequency of the resonator; and the short electrical pulses of the pulser circuit controlling the particle generator and rf source to thereby produce short bursts of said charged particles and said microwave field, respectively.

37. A tool as in claim 35 further including a target within the housing, said target receiving the accelerated charged particles.

38. A tool as in claim 35 wherein the target comprises a thin metallic foil that allows the accelerated charged particles to exit the housing.

39. A tool as in claim 35 wherein the target comprises means for emitting photons in response to stimulus by the accelerated charged particles.

* * * * *